US005667142A

United States Patent [19]

Newman

[11] Patent Number: 5,667,142

[45] Date of Patent: Sep. 16, 1997

[54] SPRAY GUN WITH REMOVABLE SUPPLY LINE

[75] Inventor: Ralph R. Newman, Englewood, Colo.

[73] Assignee: Newstripe, Inc., Aurora, Colo.

[21] Appl. No.: 453,872

[22] Filed: May 30, 1995

[51] Int. Cl.[6] ..... B05B 7/32; B05B 1/30

[52] U.S. Cl. ..... 239/346; 239/354; 239/526; 239/576; 239/600

[58] Field of Search ..... 239/114, 115, 239/527, 346, 354, 416.5, 416.4, 432, 433, DIG. 14, 576, 533.13, 526, 600

[56] References Cited

U.S. PATENT DOCUMENTS

| | | | |
|---|---|---|---|
| 1,104,217 | 7/1914 | Paasche | 239/354 |
| 1,292,318 | 1/1919 | Holton | 239/527 X |
| 2,356,865 | 8/1944 | Mason | 239/527 X |
| 2,614,000 | 10/1952 | Reinhold . | |
| 2,743,959 | 5/1956 | Nelson et al. | 239/114 |
| 2,971,700 | 2/1961 | Peeps . | |
| 3,038,750 | 6/1962 | Nielsen . | |
| 3,122,324 | 2/1964 | Lee . | |
| 3,136,486 | 6/1964 | Docken . | |
| 3,194,501 | 7/1965 | Cape | 239/576 X |
| 3,198,438 | 8/1965 | Hultgren . | |
| 3,201,047 | 8/1965 | Danberg . | |
| 3,255,972 | 6/1966 | Hultgren et al. . | |
| 3,432,104 | 3/1969 | Kaltenbach . | |
| 3,661,327 | 5/1972 | Adamson et al. . | |
| 3,758,039 | 9/1973 | Wagner . | |
| 4,171,097 | 10/1979 | Rebold | 239/346 X |
| 4,286,755 | 9/1981 | Shipman | 239/576 X |
| 4,426,062 | 1/1984 | Bowron . | |
| 4,804,144 | 2/1989 | Denman . | |
| 4,936,511 | 6/1990 | Johnson et al. . | |
| 5,078,322 | 1/1992 | Tomtore | 239/346 X |

FOREIGN PATENT DOCUMENTS

| | | | |
|---|---|---|---|
| 37314 | 1/1969 | Finland | 239/576 |
| 1465033 | 1/1966 | France . | |
| 2709217 | 7/1978 | Germany | 239/346 |
| 4226928 | 2/1994 | Germany | 239/346 |
| 2805 | 2/1993 | WIPO | 239/346 |

*Primary Examiner*—Kevin Weldon

*Attorney, Agent, or Firm*—Donald W. Margolis; Edwin H. Crabtree

[57] ABSTRACT

A pneumatically operated spray gun for dispensing fluid materials, and having a disposable supply hose for eliminating dean up problems common when using more expensive hoses and fittings. As a result, the spray gun is easy to dean and maintain since no spray material is introduced through internal parts of the spray gun, such as valves, passages, and inlet and outlet ports. The spray gun includes a gun housing having an air inlet port, an air outlet port, and a spring biased air valve disposed between the inlet and the outlet ports. The air valve is biased in a closed position. A trigger is pivotally attached to the gun housing and engages the air valve. The trigger is also attached to one end of a spring biased pinch valve mounted in the housing. Another end of the pinch valve is biased against one end of a material disposable supply hose for pinching off the supply of material therethrough. An end of the disposable supply hose is attached to the housing and disposed adjacent an end of the air outlet port. When the trigger is squeezed the air valve is moved to an open position allowing pressurized air to flow from the air inlet port to the air outlet port. Simultaneously, the trigger moves the pinch valve releasing it from the side of the disposable supply hose, thereby allowing material to flow through the hose and engage an air stream emitted from the end of the air outlet port.

18 Claims, 1 Drawing Sheet

SPRAY GUN WITH REMOVABLE SUPPLY LINE

BACKGROUND OF THE INVENTION (a) Field of the Invention

This invention relates to spray guns for spraying different types of fluid materials on an object, and more particularly, but not by way of limitation, to a pneumatically operated spray gun having a disposable material supply hose, thereby greatly reducing the time and care required in dean the spray gun after a spraying operation.

(b) Discussion of Prior Art

Heretofore most spray guns used for spraying a fluid material, such as paint, have the paint flow through the internal ports, valves, and passages in the gun housing. Properly cleaning these types of spray guns is time consuming, but if cleaned improperly the spray gun may dog and in extreme cases, if the gun is not properly cleaned it may need to be discarded. Also when paint is pumped to the gun from an open container or pushed from pressurized tank expensive hoses, fittings and a dip tube are normally used, and this equipment must also be cleaned thoroughly to avoid subsequent dogging problems.

In U.S. Pat. No. 4,936,511 to Johnson et al; U.S. Pat. No. 4,804,144 to Denman; U.S. Pat. No. 3,758,039 to Wagner; U.S. Pat. No. 3,432,104 to Kaltenbach; U.S. Pat. No. 3,255,972 to Hultgren et al; U.S. Pat. No. 3,201,047 to Danberg; and U.S. Pat. No. 3,136,486 to Doeken, various types of spray guns are shown with disposable containers, cups, and apparatus for mixing and spraying different types of materials. None of the above-mentioned prior art patents provides the unique structure and advantages of the subject invention by providing a fluid spray or ejection device for spraying or ejecting different types of fluid materials which allows for ease of cleanup by providing a disposable material supply hose, as described herein, thereby greatly reducing the time required during a clean up operation.

SUMMARY OF THE INVENTION

In view of the foregoing, it is an object of the present invention to provide a fluid spray or ejection device for spraying or ejecting different types of fluid materials which allows for ease of cleanup which is not time consuming.

Another object of the present invention is to provide a spray gun with an inexpensive material hose which can be discarded and replaced with a new hose after each spraying operation.

Still another object of the present invention is to provide an inexpensive supply line having an air seal inserted through a removable lid which is a part of a material supply tank for holding the to-be-sprayed fluid material.

Yet another object of the present invention is to provide a spray gun wherein no material is introduced through internal parts of the gun such as valves, passages, inlet and outlet ports, and other moving parts thereby eliminating the need to clean the spray guns internal parts and eliminating any chance of the internal parts of the spray gun clogging, and therefore having to be disposed of because fluid left therein has hardened and clogged the mechanism.

A further object of the present invention is to provide a spray gun which does not require expensive material supply lines and fittings which need to be cleaned after each spraying operation.

Another object of the present invention is to provide a fluid spray gun which has a disposable supply line so that it is convenient for an equipment rental store to provide such a spray gun to a customer so that the customer is not burdened with a messy cleanup procedure, and the rental store need not worry as to whether the spray gun and material supply tank have been properly cleaned.

Still another object of the present invention is to provide a spray gun system in which the supply hose is coupled with a disposable liner hag in a supply tank so that after the spraying operation is completed both the hose and the empty liner bag may be discarded and the spray gun and tank may be reused with another new supply hose and another new tank liner bag.

As described in greater detail below, the subject device, with a disposable material supply hose, includes a housing having a gas inlet port, a gas outlet port, and may have an air valve disposed between the inlet and outlet ports. Where an air valve is included, it is normally biased in a dosed position, but is movable to an open position. A trigger is attached to the housing, and where an air valve is present, engages the air valve in a manner which allows the air valve to be moved against the bias and into an open position to allow gas to flow between the gas inlet port and the gas outlet port. The trigger is also linked to one end of a valve, such as a normally closed biased pinch valve, mounted in the spray gun housing. Another end of the pinch valve is biased against one end of a material removable supply hose for dosing off the supply of material through the supply hose.

One end of the removable supply hose is attached to the housing and is disposed adjacent an end of the air outlet port, while the other end of the supply hose is located in the supply of to-be-sprayed fluid.

In operation, when the trigger is squeezed the air valve, if one is present, is moved to an open position allowing pressurized air to flow from the air inlet port to the air outlet port. At the same time the trigger opens the pinch or other valve releasing it from its biased position against the supply hose and allowing material to flow through the supply hose and engage an air stream emitted from the end of the air outlet port.

The removable supply line is inexpensive, and has an air seal inserted through a lid which is a part of a material supply tank for holding the to-be-sprayed fluid material. In preferred embodiments, such a tank has a disposable liner bag therein, so that when the spraying operation is completed, not only can the removable supply line be discarded, but the tank liner bag can also be disposed of, so that a new hose and liner bag can be used for the next operation. Such a device may thus be operated in such a manner that no material is introduced through internal parts of the gun such as valves, passages, inlet and outlet ports, and other moving parts thereby eliminating the need to clean the spray guns internal parts and eliminating any chance of the spray gun dogging or having to be disposed of because fluid left therein has hardened in the spray gun. As set forth in greater detail below, the present invention provides a spray gun which does not require expensive material supply lines and fittings which need to be cleaned after each spraying operation.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they maybe precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENT

Figure 1:
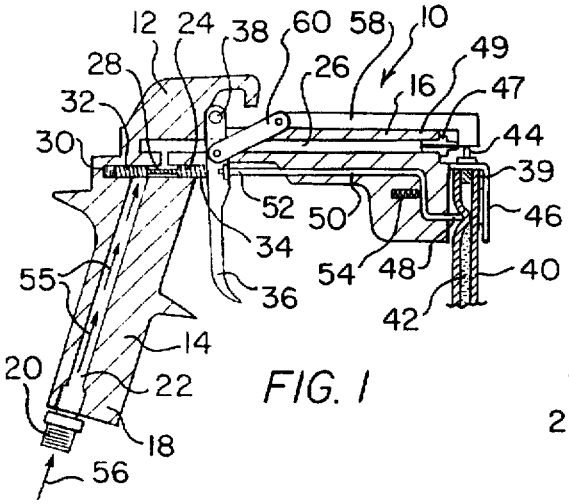
FIG. 1 is a cut away view of a subject spray gun with disposable supply hose with an air valve in a closed position and the supply hose in a closed pinched position.

As shown in FIG. 1, the fluid spray gun of the present invention is shown in a side cut away view to show the internal mechanism thereof. The spray gun is designated by general reference numeral 10 and includes a gun housing 12 having a handle 14 and barrel 16. Attached to a bottom 18 of the handle 14 is an air hose fitting 20 for attaching the gun 10 to a state-of-the art pressurized air supply hose. The air hose is not shown in the drawings. An air inlet port 22 is disposed along the length of the handle 14 with an air valve 24 disposed in the top of the handle 14 and communicating with the air inlet port 22 and an air outlet port 26. The air outlet port 26 runs the length of the barrel 16. The air valve 24 rides in an air valve port 28 and is spring-biased by a coil spring 30 which engages a first end 32 of the air valve 24. A second end 34 of the air valve extends outwardly from the handle 14 and engages a portion of a trigger 36. The trigger is pivotally attached to the housing 12 using a pivot pin 38.

As further shown in FIG. 1, a top portion 39 of a disposable material supply hose 40 is shown in cross section with material 42 such as paint, chemicals, water mixtures, etc. shown therein. Disposable supply hose 40 is normally open and cylindrical, and is composed of a resilient material, such as rubber or polymeric material. The top portion 39 of the disposable hose 40 is received around a material outlet orifice 44 attached to an inverted "L"-shaped bracket 46 attached to the front of the barrel 16. The orifice 44 is disposed next to and at an angle to an air outlet orifice 47 mounted in an end 49 of the air outlet port 26. The disposable hose 40 is shown pinched to prevent material 42 from passing through the orifice 44 by a first end 48 of a pinch valve 50. A second end 52 of the pinch valve 50 is attached to the trigger 36. The pinch valve 50 is biased again the disposable hose 40 by a coil spring 54 mounted in the barrel 16 of the housing 12.

Continuing in FIG. 1, the coil spring 30 biases the air valve 24 in a dosed position preventing pressurized air, shown as arrows 55 from passing around and through the valve 24 and into the air outlet port 26. In turn the coil spring 54 biases the pinch valve 50 against the supply hose 40 to prevent the material 42 from passing through the material outlet orifice 44.

Figure 2:
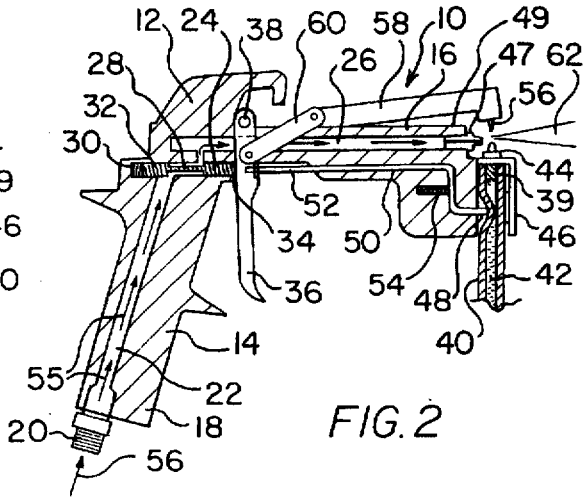
FIG. 2 is a side cut away view, similar to FIG. 1, of the spray gun with a trigger moved slightly squeezed toward a handle of the gun opening the air valve but with the supply hose remaining in a closed pinched position.
Figure 3:
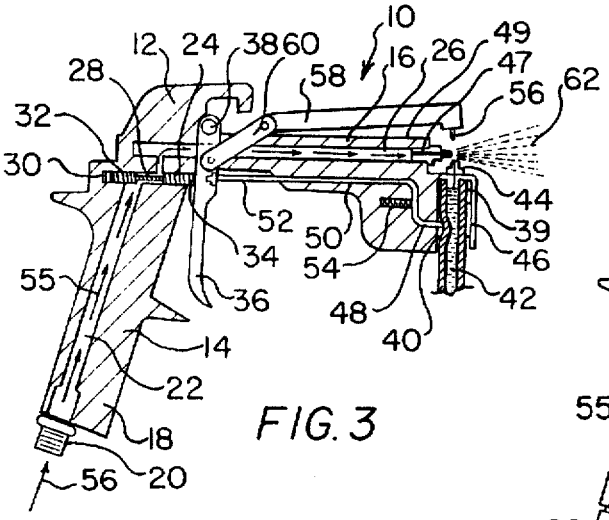
FIG. 3 is a side cut away view, similar to FIGS. 1 and 2, of the spray gun with the trigger squeezed toward the handle of the gun with the air valve and supply hose opened and spraying material therefrom.

As an added feature to the gun 10, and to make sure that there is no blockage in the material outlet orifice 44, a cleaning pin 56 is received through the opening in the orifice 44. The cleaning pin 56 can be seen in FIGS. 2 and 3. The pin 56 is attached to a pin arm 58 resting on top of the barrel 16. The pin arm 58 is attached to the trigger 36 via a link arm 60. When the trigger 36 is squeezed toward the handle 14 as shown in FIG. 2 and FIG. 3, the link arm 60 and pin arm 58 rotate upwardly with the pin 56 lifted out of the opening in the outer orifice 44. In turn, when the trigger 36 is released after spraying, the pin arm 58 and pin 56 drop downward with the pin 56 again received in the outlet orifice 44, thereby preventing any material trapped therein from hardening and dogging the supply of the material 42.

In FIG. 2 the trigger 36 has been squeezed slightly toward the handle 14 opening the air valve 24 to allow pressurized air to escape through the outlet port 26. In the position shown in FIG. 2, the trigger 36 has not been squeezed sufficiently to allow the pinch valve 50 to release the pinched disposable supply hose 40. The trigger 36 has moved the pin arm 58 and the cleaning pin 56 upwardly away from the material outlet orifice 44 and the pin arm 58 has opened the orifice 44 for receiving the material 42 therethrough. It is noted that, in the configuration of FIG. 2, that there is now an air spray 62 emitting from the air outlet port 26 and through the air outlet orifice 47.

While the subject spray gun 10 is discussed herein with the air valve 24 disposed between the air inlet port 22 and the air outlet port 26, it can be appreciated by those skilled in the art of material spray equipment, that the spray gun 10 would work equally well without the air valve 24 and a continuous supply of pressurized air would pass through the housing 12. In such an embodiment the trigger 36 would be needed only to release the pinched disposable supply hose 40, so that the material 42 can pass therethrough.

As shown in FIG. 3, the trigger 36 has been squeezed further toward the handle 14, thereby causing the pinch valve 50 to be moved from right to left toward the handle 14, and against the bias force of the coil spring 54. As a result, the disposable supply hose 40, being made of a resilient material, returns to its normally open cylindrical shape. This allows the material 42 to pass through the top portion 39 of the hose 40, and thence through the air outlet orifice 47 into the air spray 62 for mixing with the pressurized air 55 for applying the material 42 during a spraying operation. The material 42 can be under pressure as described in the discussion of FIG. 7 below, or can be drawn up the disposable supply hose 42 through a siphoning action, or by vacuum created by the Bernouli effect of air spray 62 as it passes by the top of the material outlet orifice 44.

In reviewing FIGS. 1, 2, and 3, it can be seen that none of the material 42 passes through the internal parts of the gun 10. Further, the cleaning pin 56 is designed to drop back into the material outlet 44 after the air valve 24 is closed by releasing the trigger 36, thereby preventing any possible clogging of the orifice 44. Therefore, after completing the spray operation, the disposable supply hose 40 is removed from the bracket 46 and disposed of, and no cleaning of the spray gun is required.

Figure 4:
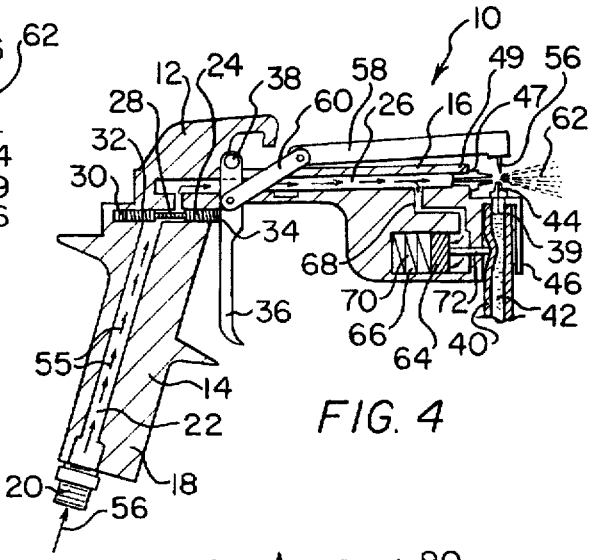
FIG. 4 is a side cut away view of a modified version of the spray gun, with a spring biased air piston used for pinching the supply hose dosed.

In FIG. 4 an alternate embodiment of the spray gun 10 is shown with this view similar to FIG. 3. The spring-biased pinch valve 50 is eliminated and a spring-biased, air-operated piston 64 is received in a cylinder 66 in the barrel 16 of the housing 12. The cylinder 66 is connected to the air outlet port 26 via an air channel 68. When the air valve 24 is in a dosed position as shown in FIG. 1, a coil spring 70 in the cylinder 66 and on one side of the piston 64 biases the piston 64 to the fight. The piston 64 includes a piston rod 72 extending outwardly from the housing 12 for engaging and pinching the disposable supply hose 40, thereby preventing material 42 from entering the outlet orifice 44.

In the embodiment of FIG. 4, when the trigger 36 is squeezed and increased air pressure is received in the air outlet port 26, air pressure is received in the cylinder 66 and is applied against the piston 64 and spring 70, thereby moving the piston 64 to the left and compressing the spring 70 with the rod 72 releasing the pinched disposable supply hose 40 and allowing the material 42 to enter into the air spray 62 for the spraying operation.

Figure 5:
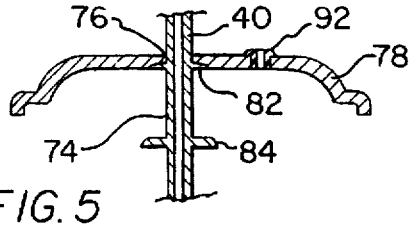
FIG. 5 is a side sectional view of a lower portion of the supply hose with air seal and a removable tank lid.
Figure 6A:
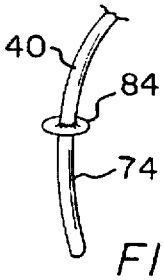
FIG. 6A and FIG. 6B are perspective views of a portion of the supply hose passed through a removable tank lid, with two different types of air seals.
Figure 6B:
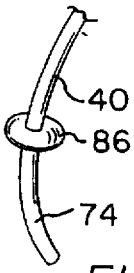
Figure 7:
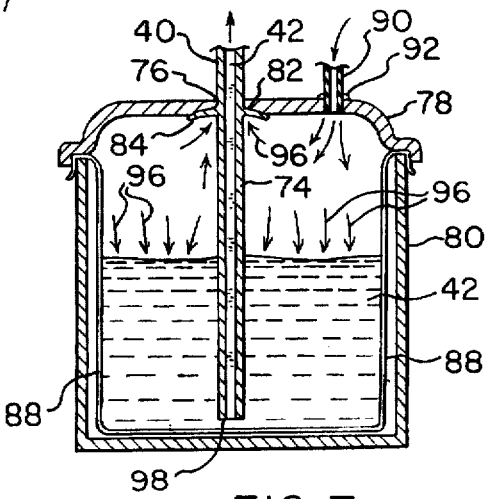
FIG. 7 is a side sectional view of a material supply tank with disposable liner bag, removable lid and a lower portion of the supply hose used for supplying material to the spray gun.

Referring now to FIG. 5, a cross section of a lower portion 74 of the disposable supply hose 40 is shown received through an aperture 76 in a removable lid 78 which is part of a supply tank 80 shown in FIG. 7. On the underside of the lid 78 is a cavity 82 for receiving the top of a diaphragm seal 84 which is welded to the sides of the lower portion 74 of the hose 70 as shown in FIG. 6A, or the cavity 82 can be contoured to receive an "O" ring 86 secured to the sides of the lower portion 74 of the hose 70 as shown in FIG. 6B. The diaphragm seal 84 or "O" ring 86 when received in the cavity 82, prevent any loss of pressurized air from around the sides of the aperture 76.

In FIG. 7 the lower portion 74 of the hose 40 is shown received in the tank 80 with lid 78 thereon. For ease in cleanup the material 42 is stored in a liner bag 88 received around the sides and bottom of the tank 80. When handling heavier and more viscous materials, the tank 80 is pressurized by attaching a pressurized air hose 90 to an opening 92 in the top of the lid 78. Air pressure indicated by arrows 96 received from the air hose 90 applies pressure against the diaphragm seal 84 forcing the seal 84 into the cavity 82 to insure no leakage around the sides of the aperture 76. Also, the air pressure 96 helps pressurize the material 42 up a bottom 98 of the hose 40 and into and through the material outlet orifice 44 when the trigger 36 has opened up the air pressure in the spray gun 10 for applying the material 42 when spraying an object.

While specific forms of housings, valves, clamps and the like have been shown, it will be understood that other art known equivalents may be used. While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A pneumatically operated, easily cleaned spray device for spraying fluid materials, said spray device being connected to a pressurized gas source and being connected to a source of material to be sprayed, said spray device including a housing having a gas inlet port for receiving pressurized gas and a coupled gas outlet port for passing the pressurized gas externally outwardly from said housing, and actuating means operatively attached to the device housing, wherein the improvement includes, in combination:

fluid outlet means carried by said device and locked external to said housing and downstream from said gas outlet port in a manner such that pressurized gas passing outwardly from said gas outlet port intersects with any fluid which is released from said external fluid outlet means to produce an external spray; and means carried by said device, and external to said housing, for removably receiving and connecting a removable fluid supply line which is to be connected to an external supply of fluid to said fluid outlet means, said actuating means setting to selectively open and close such a fluid supply line.

2. The spray device as described in claim 1 further including a normally dosed gas valve disposed intermediate said gas inlet port and said gas outlet port, and wherein said actuating means also serves to selectively open said gas valve sequentially in a manner such that when said actuating means opens a fluid supply line it also opens said gas valve so that pressurized gas from said gas outlet port will intersect with any fluid which is released from said fluid outlet means and thereby spray any such fluid.

3. The spray device as described in claim 2 wherein said gas valve and said fluid valve are normally retained in a dosed position by biasing means.

4. The spray device as described in claim 1 further including a removable fluid supply line having a first end and a second end, said fluid supply line having its said first end removably connected to said fluid outlet means by said fluid supply line receiving and connecting means, said fluid supply line being positioned to be selectively opened and closed by said actuating means.

5. The spray device as described in claim 4 wherein means for engaging said fluid supply line for normally closing said fluid supply line to control the supply of fluid therethrough, and for selectively opening said fluid supply line is operatively connected to said device, said line engaging means being intermediate said actuating means and said fluid supply line, said line engaging means being connected to and actuated by said actuating means to selectively open said fluid supply line.

6. The spray gun as described in claim 5 wherein said line engaging means is biased to normally impede the flow of fluid through said fluid supply line.

7. The spray gun as described in claim 6 wherein said line engaging means is a spring-biased pinch valve having a first end linked to said actuating means and a second end normally engaging a portion of said fluid supply line to thereby impede the supply of fluid therethrough.

8. The spray device as described in claim 4 wherein said second end of said fluid supply line is connected to an external source of fluid.

9. The spray device as described in claim 8 wherein said first end of said supply tube is received through a cover carried by a fluid supply container.

10. The spray device as described in claim 9 wherein said cover is sealed to said fluid supply container, said fluid supply container is pressurized, and wherein further, seal means are disposed on a portion of said second end of said fluid supply line tube for engaging the inner surface of said lid to prevent loss of pressure therein.

11. The spray device as described in claim 9 wherein said spray device is in the form of a gun, and said actuating means includes a trigger.

12. A pneumatically operated, easily cleaned device for ejecting fluid materials, the ejecting device being connectable to a source of gas under pressure and to a source of to-be-ejected fluid material, the ejecting device comprising:

a housing having a gas inlet port for receiving pressurized gas;

a gas outlet port coupled to said gas inlet port for passing pressurized gas outwardly therefrom;

an activating trigger carried by said housing;

a removable fluid material supply line having a first end externally attached to said housing adjacent to and downstream of said gas outlet port, and a second end for connection to an external source of fluid material; and a valve carried by said housing, said valve being operatively linked to said activating trigger, said valve being normally positioned to close said fluid material supply line and inhibit the flow of material through said removable fluid material supply line, said valve being activatable by said trigger to open said fluid material supply line and allow the flow of material through said removable fluid material supply line, and external to said housing.

13. The ejecting device as described in claim 12 further including a gas valve disposed between said inlet port and said outlet port, said valve being operatively linked to said activating trigger, said gas valve being normally biased in a dosed position to inhibit the flow of pressurized gas between said inlet port and said outlet port, said gas valve being activatable by said trigger to allow the flow of pressurized gas between said inlet port and said outlet port.

14. The ejecting device as described in claim 12 further including a material outlet orifice connected to said first end of said supply line and disposed at an angle to said gas outlet port.

15. The spray gun as described in claim 14 further including a cleaning pin for receipt in said material outlet orifice, said cleaning pin being connected to a pivot means, said pivot means being linked to said trigger for pivoting said cleaning pin upwardly away from said material outlet orifice when said trigger is squeezed.

16. An easily cleanable device for ejecting fluid materials, the ejecting device being connectable to a source of to-be-ejected material, the ejecting device comprising:

a housing; a gas outlet carried by said housing;

an activating trigger carried by said housing;

a removable fluid material supply line having a first end attached to and external to said housing adjacent to and downstream of said gas outlet port, and a second end for connection to an external source of material; and a valve carried by said housing, said valve being operatively linked to said activating trigger, said valve being normally positioned to close said external fluid material supply line and inhibit the flow of fluid material through said removable fluid material supply line, said valve being activatable by said trigger to open said fluid material supply line and allow the flow of material through said removable fluid material supply line, and external to said housing.

17. The ejecting device as described in claim 16 wherein said valve means is a retractable spring-biased piston with a piston rod being normally biased against a portion of said line, said piston rod being retractable by said trigger to open said supply line and allow the flow of to-be-ejected material through said removable supply line.

18. A pneumatically operated, easily cleaned device for ejecting fluid materials, the ejecting device being connectable to a source of gas under pressure and to a source of to-be-ejected fluid material, the ejecting device comprising:

a housing having a gas inlet port for receiving pressurized gas;

a gas outlet port coupled to said gas inlet port for passing pressurized gas outwardly therefrom;

an activating trigger carried by said housing;

a removable fluid material supply line having a first end attached externally to said housing adjacent to and downstream of said gas outlet port, and a second end for connection to an external source of fluid material;

a fluid material outlet orifice connected to said first end of said fluid material supply line and disposed at an angle to said gas outlet port;

a cleaning pin adapted and located for receipt in said fluid material outlet orifice, said cleaning pin being connected to a pivot means, said pivot means being linked to said trigger for pivoting said cleaning pin upwardly away from said material outlet orifice when said trigger is squeezed; and a valve carried by said housing, said valve being operatively linked to said activating trigger, said valve being normally positioned to close said fluid material supply line and inhibit the flow of material through said removable fluid material supply line, said valve being activatable by said trigger to open said fluid material supply line and allow the flow of material through said removable fluid material supply line.

* * * * *